US007195296B2

(12) United States Patent
Swift et al.

(10) Patent No.: US 7,195,296 B2
(45) Date of Patent: Mar. 27, 2007

(54) PORTABLE REMOTE HYDRAULIC ACTIVATOR

(76) Inventors: Robert Swift, P.O. Box 1102, Murray, KY (US) 42071; Darren Grogan, 201 Grogan La., Breman, KY (US) 42325

( * ) Notice: Subject to any disclaimer, the term of this patent is extended or adjusted under 35 U.S.C. 154(b) by 357 days.

(21) Appl. No.: 10/077,955

(22) Filed: Feb. 20, 2002

(65) Prior Publication Data

US 2002/0121790 A1 Sep. 5, 2002

Related U.S. Application Data

(60) Provisional application No. 60/269,334, filed on Feb. 20, 2001.

(51) Int. Cl.
*B65D 51/00* (2006.01)

(52) U.S. Cl. ..... 294/68.24; 294/905

(58) Field of Classification Search ..... 294/68.1, 294/68.2, 68.21, 68.22, 68.23, 68.24, 88, 294/905; 212/285; 414/909; 60/433, 434, 60/477; 91/427, 527

See application file for complete search history.

(56) References Cited

U.S. PATENT DOCUMENTS 2,801,126 A * 7/1957 White et al. ..... 294/68.24
3,195,942 A * 7/1965 Dempster et al. ..... 294/68.21
3,310,335 A * 3/1967 Shuey ..... 294/88
3,647,255 A * 3/1972 Hale et al. ..... 294/111
3,709,389 A * 1/1973 Steltz ..... 414/408
3,858,728 A * 1/1975 Fathauer ..... 294/905
3,892,079 A * 7/1975 Hirano et al. ..... 414/694
4,526,413 A * 7/1985 Williams ..... 294/905
4,776,415 A * 10/1988 Brice ..... 180/11
4,908,966 A * 3/1990 Phillips et al. ..... 294/68.23
5,205,544 A * 4/1993 Kroeger ..... 294/905
5,359,942 A * 11/1994 Ward ..... 105/240
5,579,684 A * 12/1996 Stribling ..... 100/48
5,580,113 A * 12/1996 Pomerville et al. ..... 294/82.35
5,624,237 A * 4/1997 Prescott et al. ..... 417/33
5,634,778 A * 6/1997 Liegel et al. ..... 417/313
6,019,406 A * 2/2000 McDermott et al. ..... 294/81.51
RE36,685 E * 5/2000 Bounds ..... 105/311.1
6,219,946 B1 * 4/2001 Soczka ..... 414/726

* cited by examiner

*Primary Examiner*—Eileen D. Lillis
*Assistant Examiner*—Paul T. Chin
(74) *Attorney, Agent, or Firm*—Birch, Stewart, Kolasch & Birch, LLP

(57) ABSTRACT

An apparatus that remotely actuates a hydraulic motor of a hydraulic device including a mounting device supported by the hydraulic device; a hydraulic pump located on the mounting device for supplying pressurized fluid to the hydraulic motor; a driving device located on the mounting device for the hydraulic pump; and a control device located on the mounting device, the control device including a receiver for receiving a control signal to operate the driving device. The hydraulic motor of the hydraulic device may be remotely controlled by the control signal from a remote transmitter.

9 Claims, 9 Drawing Sheets

PORTABLE REMOTE HYDRAULIC ACTIVATOR

This application claims priority on provisional Application No. 60/269,334 filed on Feb. 20, 2001, the entire contents of which are hereby incorporated by reference.

BACKGROUND OF THE INVENTION

1. Field of the Invention

The invention relates to hydraulic operations and in particular, to a remote control device for attachment to hydraulically operated equipment.

2. Background of the Related Art

Cranes are often used to lift hydraulically operated equipment. To operate the hydraulic equipment, hydraulic fluid lines are attached to the equipment and extend for example, from a hydraulic control device on the ground to a point of attachment on the hydraulic equipment. When the hydraulic equipment is suspended from the crane, the hose extends from the ground up to the equipment.

FIG. 1, for example, illustrates a prior art method of operating a hydraulic device suspended from a crane 10 by crane arm 12 and below a weight ball 14. A container 1 with an open top 3 and a bottom 5 having two hinged doors 4 and 6, which are opened and closed using hydraulic pressure applied to hydraulic cylinders 19, is suspended from the crane 10. The container 1 may take the form of a hydraulic dumpster 1 used to receive roofing materials which have been removed from a roof. Hydraulic lines 7 and 8 run from a reel 16 on the ground to the container 1 and are used to provide the necessary hydraulic pressure to open and close the doors 4 and 6 of the container 1. A control device 18 including a hydraulic pump and control panels is located adjacent the reel 16. To open and close the doors 4 and 6 on the hydraulic dumpster 1, an operator uses a control panel on the control device 18.

As shown in FIG. 1, the hydraulic lines 7 and 8 are not entirely connected to the crane arm 12 or the weight ball 14. The freedom of lines 7 and 8 is problematic. For example, when lifting hydraulically controlled devices above a building roof 2, the lines 7 and 8 may bump against the building roof and become caught or damaged by the roof or gutters. Additionally, the lines 7 and 8 may knock down safety fences required by the Occupational Safety & Health Association (OSHA) on the perimeter of elevated areas such as roofs.

SUMMARY

The present invention is directed to overcoming the above-identified problems of the background art. One embodiment of the invention is an apparatus for remotely actuating a hydraulic motor of a hydraulic device including a mounting device supported by the hydraulic device; a hydraulic pump located on the mounting device for supplying pressurized fluid to the hydraulic motor; a driving device located on the mounting device for driving the hydraulic pump; and a control device located on the mounting device, the control device includes a receiver for receiving a control signal to operate the driving device. The apparatus permits the hydraulic motor of the hydraulic device to be remotely controlled by the control signal. Further, the hydraulic device may be a bottom-dumping container.

The apparatus may also include a wireless transmitter located remotely from the receiver for sending the control signal to the receiver, whereby the hydraulic device may be remotely controlled by the control signal from the transmitter. Further, the hydraulic motor may be a hydraulic cylinder, which opens a door of a container to dump contents from the container.

The driving device may be an electric motor for driving the hydraulic pump; and the electrical power source may be a battery. Additionally, the mounting device may be an enclosure that encloses the hydraulic pump, the driving device and the control device.

A second embodiment of the present invention includes a system to operate a device suspended from a crane. The system includes a pump for pumping fluid to a hydraulic cylinder on the device; a power source for providing power to the pump; a controller electrically connected to the pump and including a receiver for receiving a control signal for controlling the transmission of power to the pump; and a transmitter for remotely transmitting the control signal to the receiver. Further, the cylinder may open and close a door on the device.

The system may also include an enclosure containing the pump, controller and power source; and a mount connected to an exterior side of the enclosure for connecting the enclosure to the device. The mount may have a planar portion with two rails extending away from the enclosure and forming a point of connection between the enclosure, and a second portion. Further, the enclosure may be made of metal. The system may also include a valve for controlling the direction of flow of fluid between the cylinder and pump, wherein the receiver transmits current to the valve to operate the valve.

A further embodiment of the present invention includes device, such as a hydraulic dumpster, for use when suspended from a crane. The device has a body portion for suspension from the crane; a cylinder for holding hydraulic fluid connected to the body portion; at least a first member movable by hydraulic pressure applied to the cylinder, such as a door, connected to the body portion and the cylinder; a pump, such as a hydraulic pump including a tank and motor, connected to the cylinder for pumping pressurized fluid to the cylinder; a power source for providing power to the pump; a controller connected to the body portion and electrically connected to the pump, the controller including a receiver for receiving a control signal and transmitting power from the power source to the pump based on the control signal; and, a transmitter for remotely transmitting the control signal to the receiver.

The device may also include an enclosure, which may be made of metal, and contains the pump, controller and power source; and a mount connected to an exterior side of the enclosure and body portion. The mount may have a planar portion with two rails extending away from the enclosure and forming a connection between the enclosure and body portion. Additionally, the device may include a valve for controlling the direction of flow of fluid between the cylinder and pump, and the receiver may also operate the valve by transmitting current to the valve.

In addition to the receiver, the device may include a manual switch, which is manually operated to send current from the power source to the pump.

These and other objects of the present invention will become more readily apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE FIGURES

The present invention will become more fully understood from the detailed description given hereinbelow and the accompanying drawings which are given by way of illustration only, and thus are not limitative of the present invention and wherein.

DESCRIPTION OF THE PREFERRED EMBODIMENT OF THE INVENTION

Figure 2A:
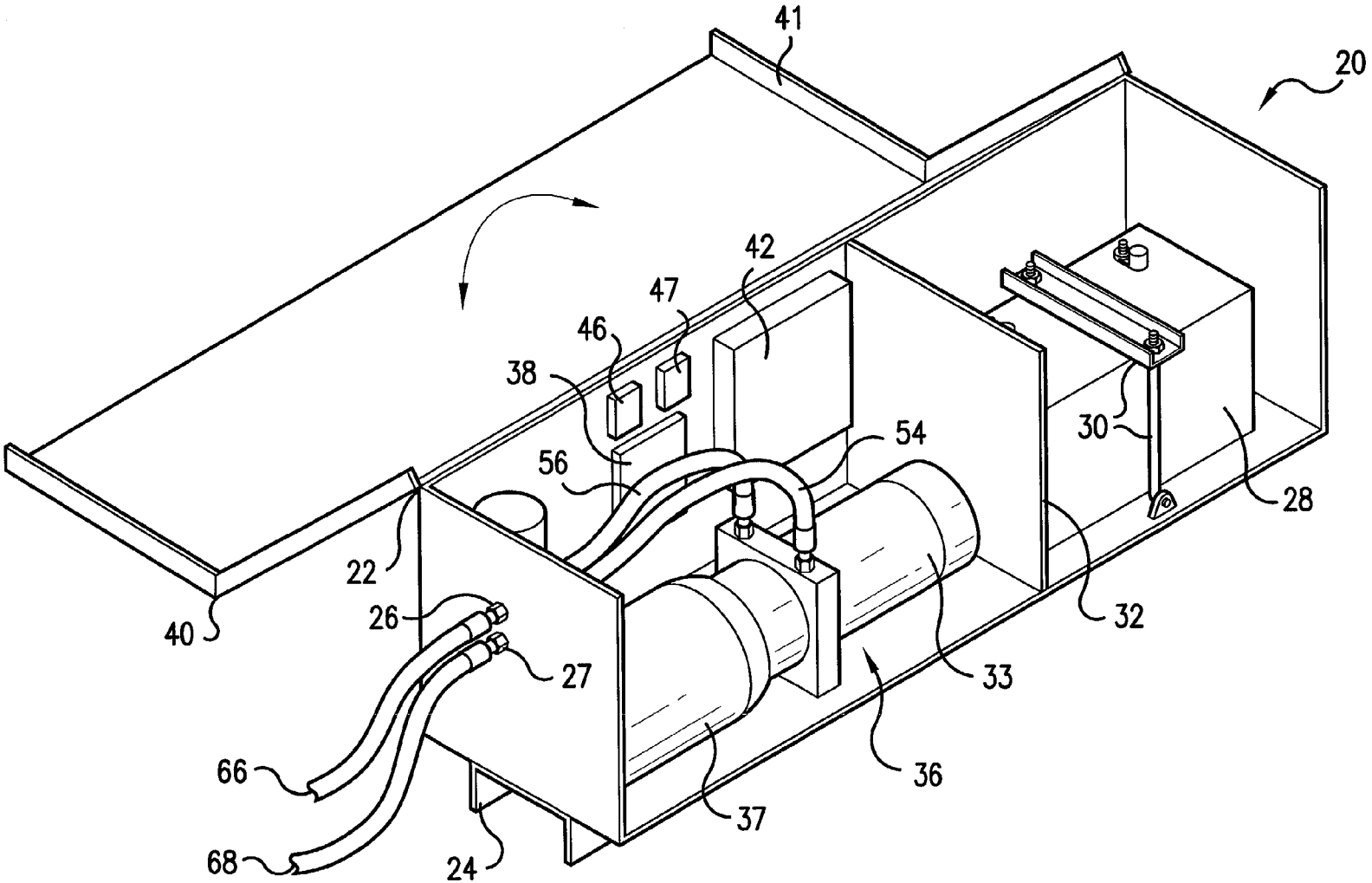
FIG. 2A depicts a remote controlled hydraulic power cabinet according to the preferred embodiment of the invention.
Figure 2B:
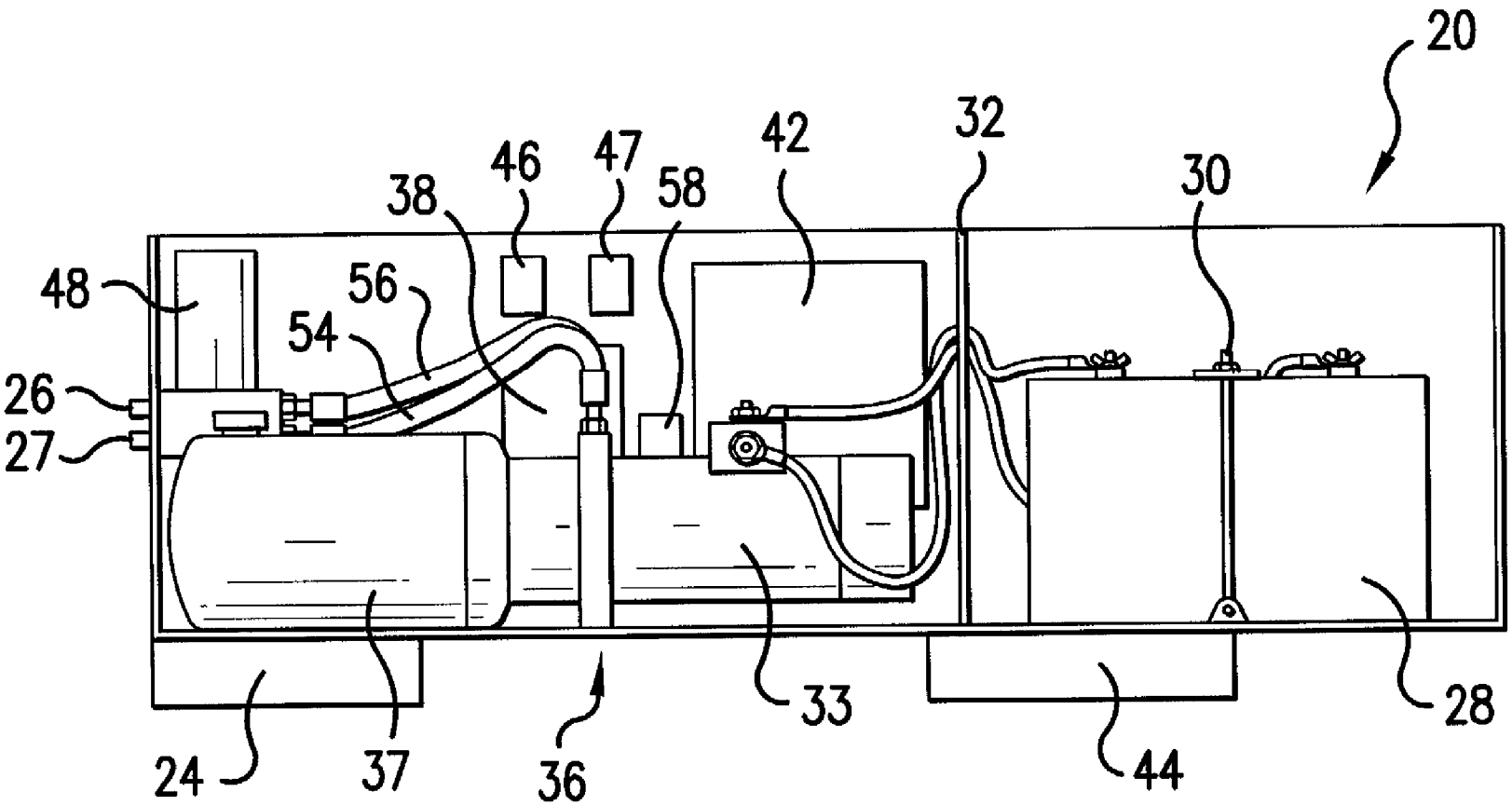
FIG. 2B depicts a side view of the remote controlled hydraulic power cabinet of FIG. 2A.
Figure 3A:
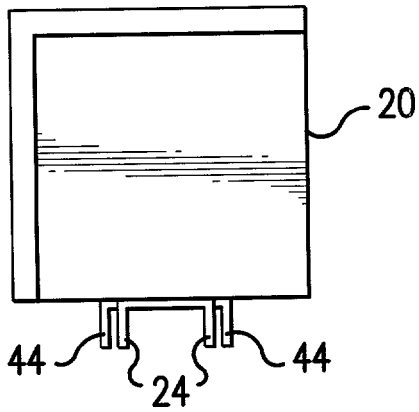
FIG. 3A depicts a side view of one embodiment of the mount on the remote controlled hydraulic power cabinet of FIG. 2A.
Figure 3B:
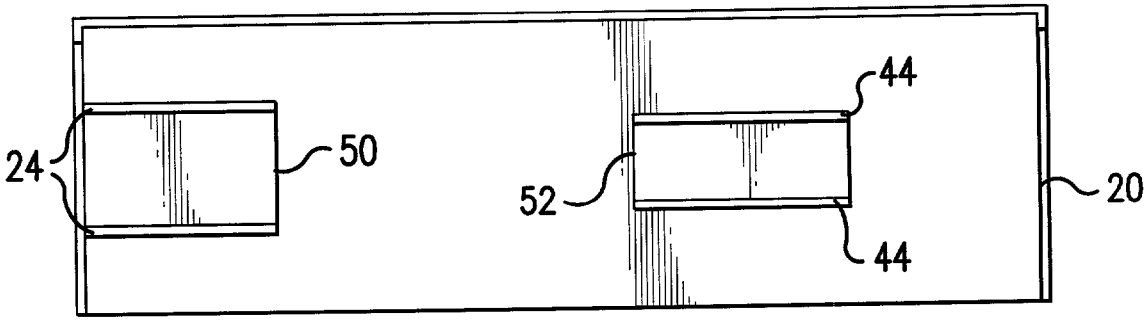
FIG. 3B depicts a top view of one embodiment of the mount on the remote controlled hydraulic power cabinet of FIG. 2A.

As shown in FIGS. 2A and 2B, the preferred embodiment of the invention includes a remote controlled hydraulic power cabinet 20. The exterior of the cabinet 20 includes two hydraulic hose connectors 26 and 27, hoses 66 and 68 respectively attached to connectors 26 and 27, mount rail portions 24 and 44 (44 is shown in FIGS. 3A and 3B) on the bottom of the cabinet 20 and a lid 40. The cabinet 20 may be made of a metal such as steel or aluminum or any other suitable material, such as plastic.

The lid 40 is connected to the cabinet 20 by a hinge 22 or other suitable method well known in the art. As shown in FIG. 2A, lid 40 corresponds to two sides of the cabinet 20. This structure allows the interior of the cabinet 20 to be conveniently accessed. However, the lid 40 may be of various shapes and sizes. Additionally, the lid 40 may be made of the same material as the cabinet 20 or a suitable different material.

The lid 40 is also structured to prevent water from entering the cabinet. As shown in FIG. 2A, the lid 40 has a lip portion 41 that overlaps the body of the cabinet. Further, weather stripping or another sealant material may be placed on portions of the lid 40 abutting the body of the cabinet 20 or directly on the cabinet 20 to form a seal with the lid 40.

The two hydraulic hose connectors 26 and 27 provide a connection for hoses 66 and 68 to connect to a hydraulic device such as a hydraulic dumpster, clam shell bucket or any other hydraulically operated equipment.

As shown in FIGS. 3A and 3B, rail portions 24 and 44 are part of a mount that also includes flat areas 50 and 52. Rail portions 24 and 44 are connected to the flat areas 50 and 52 such that each rail portion 24 and 44 is at approximately a right angle relative to the corresponding flat area 50 and 52. Also, as shown, the rail portions 24 and 44 are positioned at the edges of the flat areas 50 and 52.

Figure 6A:
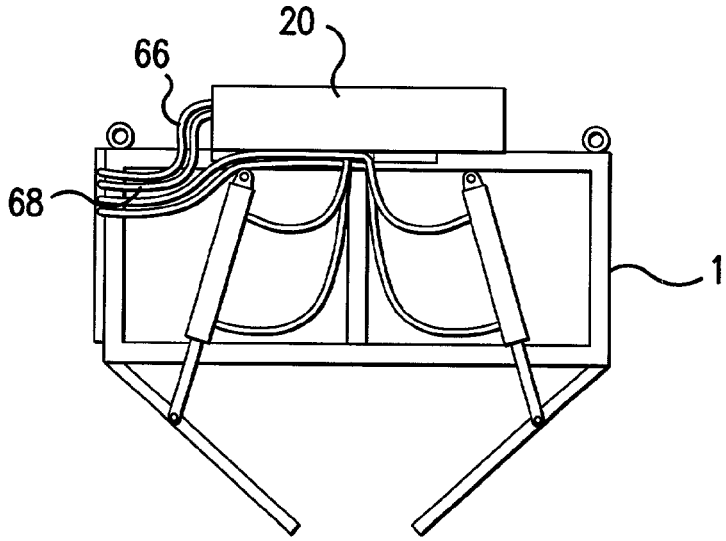
FIG. 6A depicts a hydraulic dumpster with doors hydraulically operated by the remote controlled hydraulic power cabinet of FIG. 2A.

As shown in FIG. 6A, the mount is designed so that the rail portions 24 and 44 may attach to a portion of a hydraulic device or hydraulic dumpster 1 to be suspended from the crane and provide a secure connection. The structure of the mount may be altered as needed to provide a secure connection to the specific hydraulic device. For example, the rail portions may be of different shapes and at different angles relative to the flat area. Also, the mount may be attached to the cabinet 20 in various positions. Further, the mount may be used to attach the cabinet 20 to various hydraulic devices so that the cabinet is portable.

The mount is connected to the cabinet 20 by a suitable attachment method such as welding or using nuts and bolts. Similarly, the connection of the rails 24 and 44 to the flat areas 50 and 52 of the mount also may be accomplished by a suitable attachment such as welding or the rails and flat area may be formed from a unitary piece of material such as steel or aluminum.

Figure 2C:
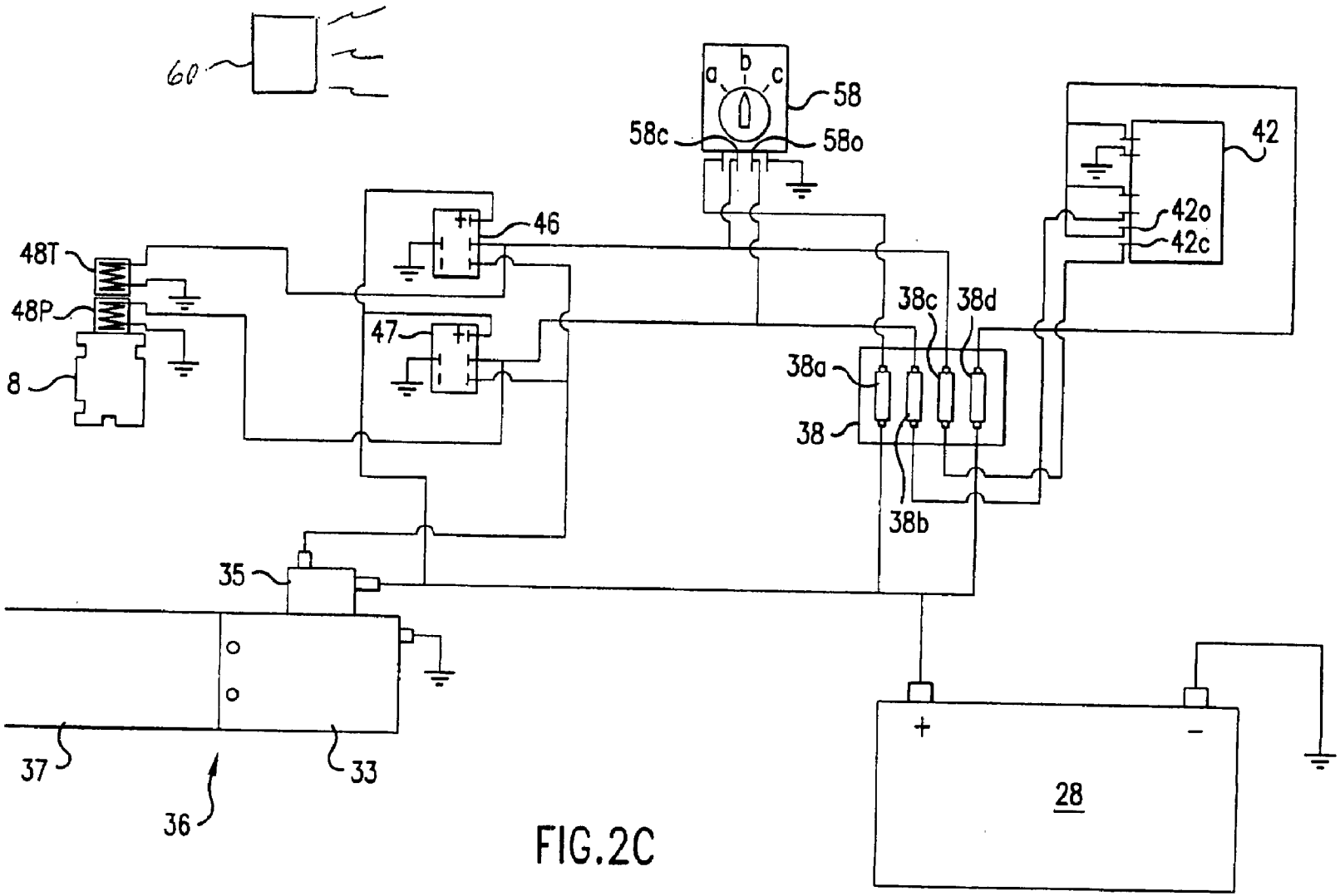
FIG. 2C depicts the electrical connections of the devices of the remote controlled hydraulic power cabinet of FIG. 2A.

FIGS. 2A–2C depict the interior of cabinet 20. As shown, cabinet 20 includes an interior wall 32, which separates the cabinet 20 into two sections. A power source 28 such as a battery is positioned in the first section. A securing clamp 30 is used for holding the power source 28 in place. The second section includes relays 46 and 47, a hydraulic pump 36 having a motor 33 and tank 37, a fuse block 38, a manual switch 58, a remote radio receiver 42 and a valve 48.

Two hoses 54 and 56 are connected between the hydraulic pump 36 and hydraulic valve 48. Hoses 54 and 56 allow the pump to pump hydraulic fluid through valve 48 and hoses 66 and 68 adjust the pressure in a hydraulic cylinder 19 for operating a hydraulic device connected to the hoses 66 and 68.

Figure 2D:
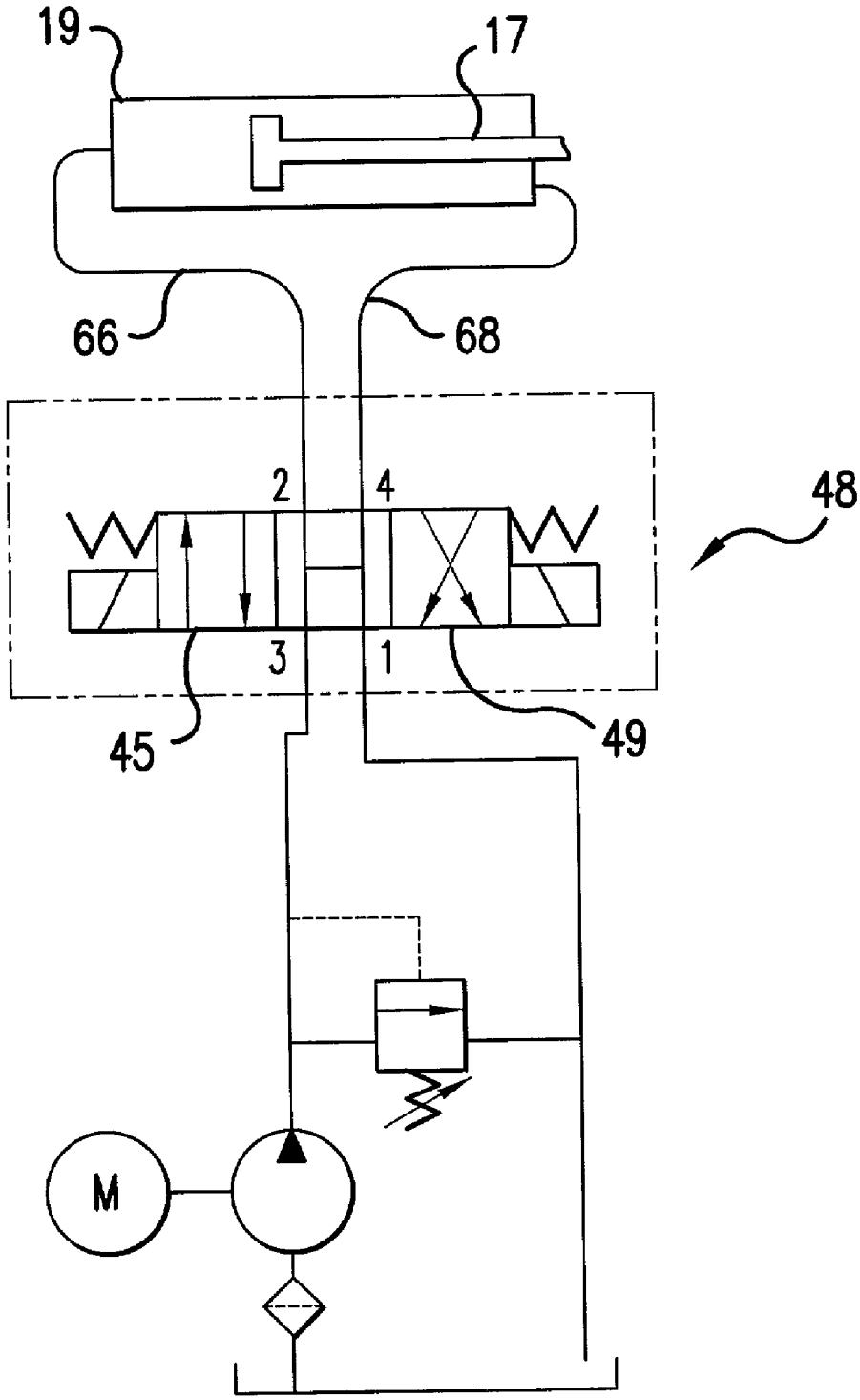
FIG. 2D depicts a schematic of the hydraulic valve of the remote controlled hydraulic power cabinet of FIG. 2A.

As shown in FIG. 2D, the valve 48 is structured to allow fluid to flow to and from a hydraulic cylinder 19 on the container hydraulic dumpster 1. Fluid may flow through lines 66 and 68 to and from the cylinder 19 depending upon the position of the valve sections 45 and 49. For example, to open the doors 4 and 6 on the hydraulic dumpster 1, the piston 17 would be extended so fluid would flow through lines 66 using valve section 45.

The power source 28 provides power to operate the devices in the cabinet 20 including the pump 36 and valve 48. In the preferred embodiment, a 12-volt battery is supplied as the power source and a 12-volt motor 33 is used to operate the hydraulic pump 36. However, the voltage level of the power source and battery may be modified to other suitable voltages. Further, other sources of power may be utilized such as solar power or a generator.

As shown in FIG. 2C, the various devices in cabinet 20 are electrically connected. The power source 28 is connected to a ground and electrically connected to the motor 33 of the hydraulic pump 36, the remote radio receiver 42, a manual switch 58 and hydraulic valve 48. The power or electric current provided to the remote radio receiver 42 and manual switch 58 is output by the power source 28 and passes through two separate fuses 38*a* and 38*d* in the fuse box 38.

As shown, in the preferred embodiment, the fuse box has four fuses 38*a*–38*d*. However, the number of fuses may be modified depending on the various embodiments.

Figure 4:
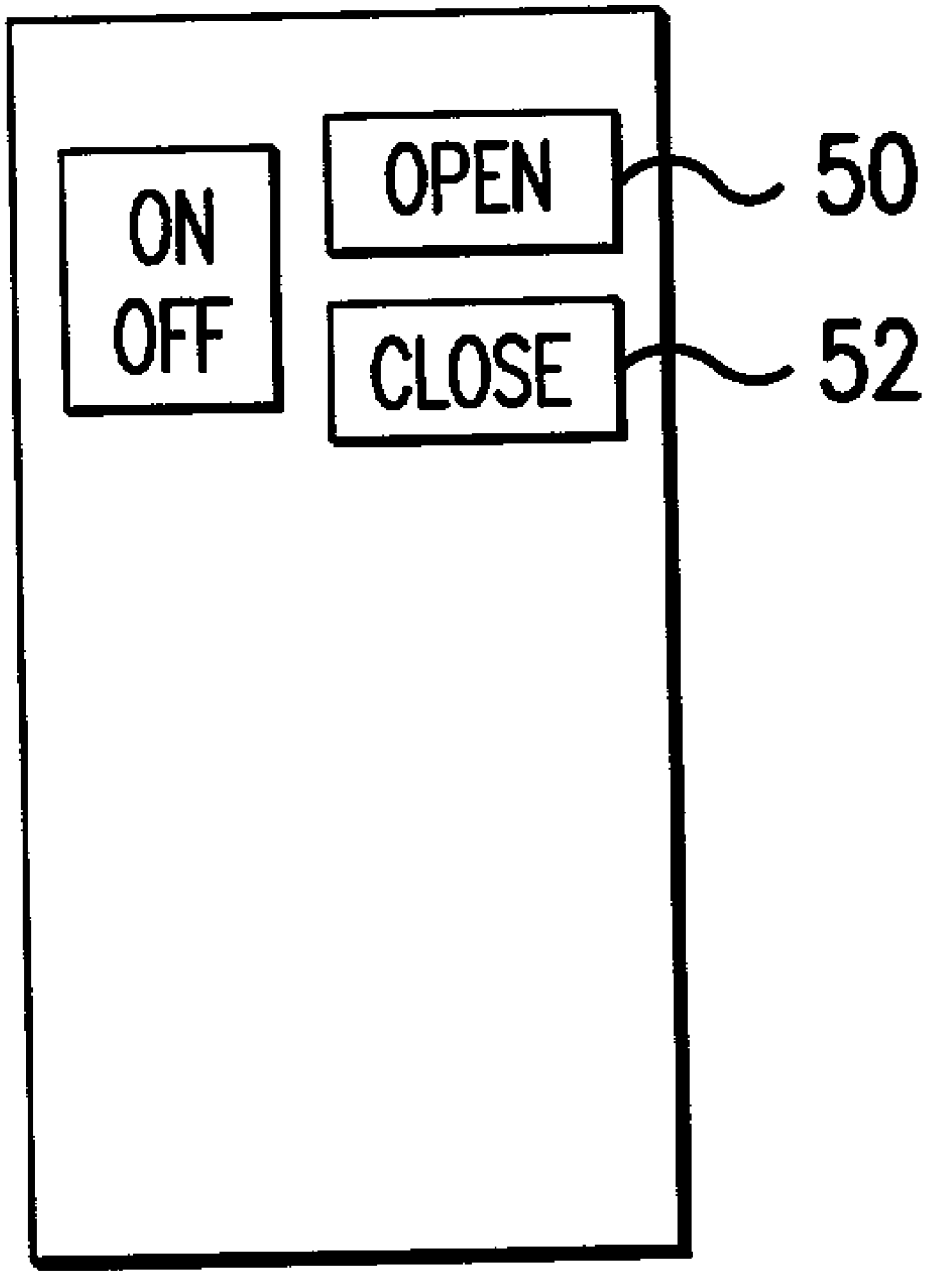
FIG. 4 depicts a remote transmitter according to the preferred embodiment of the invention.

The output of fuse 38*a* is received by the manual switch 58, and the output of fuse 38*d* is received by the remote radio receiver 42. Both the remote radio receiver 42 and manual switch 58 control whether or not power is sent to the hydraulic pump 36 and hydraulic valve 48. However, the remote radio receiver 42 and manual switch 58 differ in the method of activation. For example, the remote radio receiver 42 is activated by a remote control 60 using radio signals, as shown in FIG. 4, and the manual switch 58 requires physical force for activation.

As shown in FIGS. 2C and 2D, the valve 48 includes two circuits 48T and 48P, which receive electric current from switch 58. Circuits 48T and 48P, which respectively correspond to valve sections 45 and 49, are used to apply pressure in the cylinder 19. For example, when current is received by circuit 48T, valve 49 is used to control flow through the valve 48 and retract the piston 17 closing the doors 4 and 6 of hydraulic dumpster 1. On the other hand, when circuit 48P receives current, valve section 45 is put into position and the flow direction is changed so the doors 4 and 6 of the hydraulic dumpster 1 open. A suitable hydraulic valve may be used.

Each circuit 48T and 48P is activated when a switch 58 or receiver 42 is activated to a particular position allowing current to flow to the respective circuit 48T or 48P. For example, when manual switch 58 is placed into the "open" position c, the manual switch 58 outputs current through port 58*o*. The outputted current is directed to the relay 47 and circuit 48P which operates the valve 48 as discussed above.

Also, when manual switch 58 is placed into the "closed" position a, the manual switch 58 outputs current through port 58*c*. The outputted current is directed to the relay 46 and circuit 48T. When the current is received by the circuit 48T, the valve 48 operates as discussed above.

The relays 46 and 47 allow the hydraulic pump 36 to work in cooperation with the valve 48. For example, although a particular valve section 45 or 49 may be in place, the fluid requires force to move through the valve. The pump supplies the force and is activated when the manual switch 58 is in the "closed" position a or the open position c. For example, when the manual switch 58 is in the closed position a, current is output from the manual switch 58 to the pump 36 via relay 46. The pump 36 is also activated when the manual switch 58 is in the open position c and current is sent to the hydraulic pump 36 from the manual switch 58 via the relay 47.

The pump 36 and valve 48 may also be operated when the manual switch 58 is in the "off" position b and a remote control device 60 is used to operate the receiver 42. For example, when the receiver 42 receives a signal from the remote control 60 to open the valve, the receiver 42 sends current through port 42*o* to circuit 48P. When the current is received by the circuit 48P, the valve 48 operates as described above. Also, the receiver 42 provides current to the corresponding relay 47 so that the pump 36 operates to pump the fluid through the valve 48 to the cylinder 19.

Similarly, when the receiver 42 receives a signal from the remote control device 60 to close the valve, the receiver 42 sends current through port 42*c* to circuit 48T. When the current is received by the circuit 48T, valve 48 operates as described above. Also, the receiver 42 provides current to the corresponding relay 46 so that the pump 36 operates to pump fluid to the cylinder 19.

Figure 5:
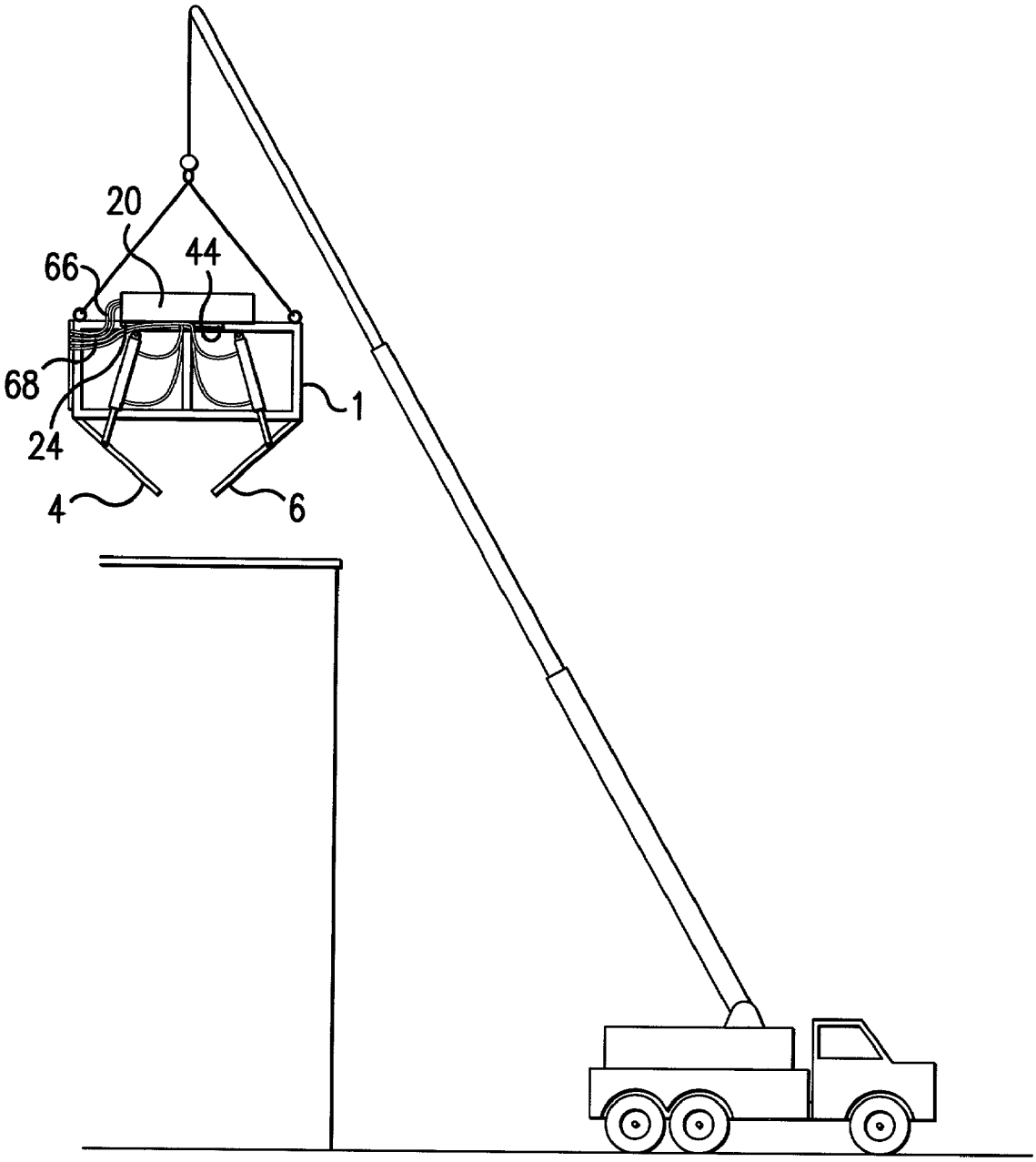
FIG. 5 depicts a hydraulic dumpster suspended from a crane being operated by the remote controlled hydraulic power cabinet of FIG. 2A.
Figure 6B:
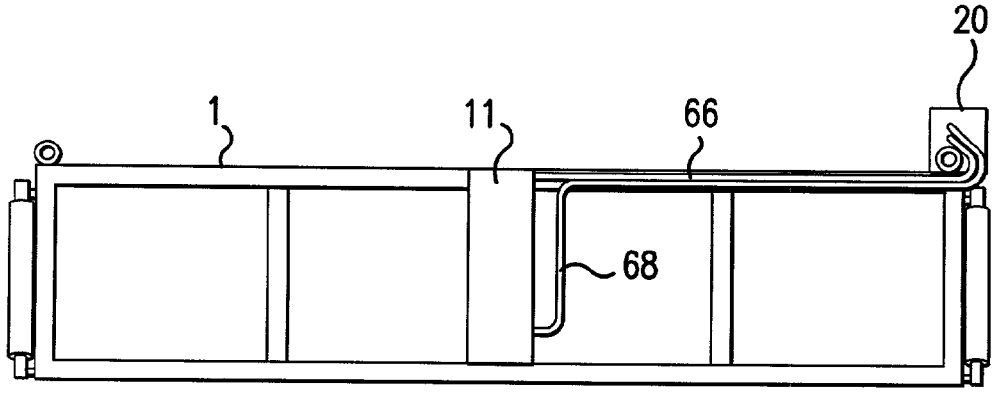
FIG. 6B depicts the remote controlled hydraulic power cabinet of FIG. 2A connected to a manifold on the side of a hydraulic dumpster.

As a result of the remote control feature of the cabinet 20 including the receiver 42 working in cooperation with the remote control 60, the need to use a manual switch or control device 18 of the background art at a ground location beneath the crane is eliminated. For example, as shown in FIGS. 5 and 6, the cabinet 20 may be mounted onto a hydraulic dumpster 1 using the mounting rails 24 and 44. Hoses 66 and 68 are connected between a manifold 11, which is connected to the cylinders 19. The hydraulic dumpster 1 may be suspended from a crane and the doors 4 and 6 opened and closed using the remote control 60.

The hydraulic dumpster 1 has two doors 4 and 6, which are hydraulically operated such that an increase in hydraulic pressure on one side of a piston 17 causes the doors 4 and 6 to open and an increase in pressure on the other side of the piston 17 causes the doors 4 and 6 to close. Therefore, pushing an "open" button 50 on the remote control 60 will send a signal to the remote sensor switch 42 to open the doors 4 and 6. As a result, the receiver 42 will output current via port 42*o* and the valve 48 and pump 36 will function as described above by pushing fluid through the valve 48 through hose 66 to increase pressure in the hydraulic dumpster 1 hydraulic unit and open the doors 4 and 6.

When a user depresses the "closed" button 52 on the remote control 60, the remote control 60 will send a close signal to the receiver 42. The receiver 42 will then send current to the valve 48 and pump 36 via port 42*c* as described above. As a result, hydraulic fluid will be pumped into cylinder 19 so that piston 17 retracts into the cylinder 19 from the hydraulic dumpster 1 and into the cabinet 20 and hydraulic pump 36 tank, and the doors 4 and 6 of the hydraulic dumpster 1 will close.

Figure 1:
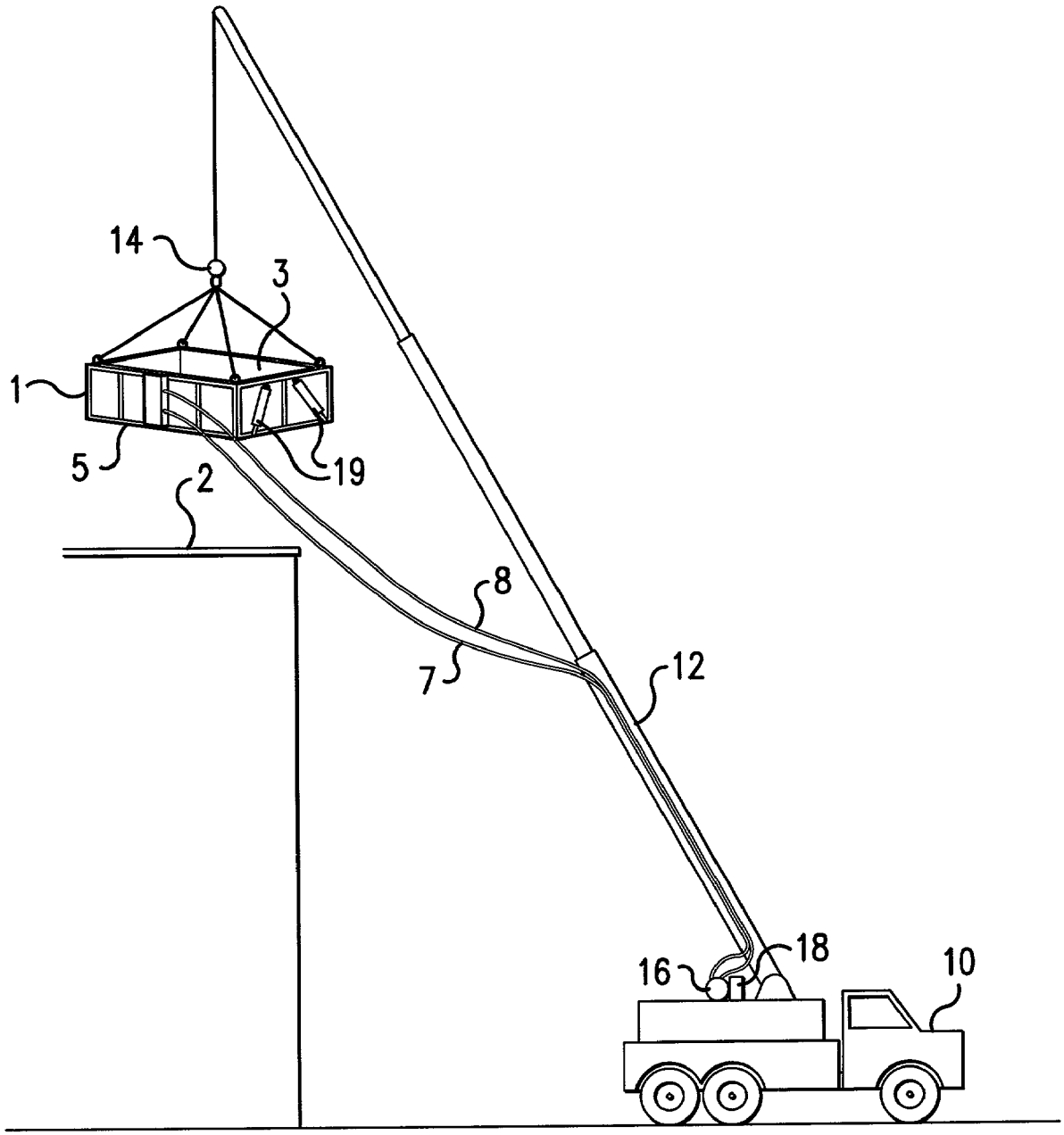
FIG.1 PRIOR ART
FIG. 1 depicts a hydraulic dumpster and hydraulic lines connected to a crane according to the prior art.

The present invention is beneficial in that the ability to remotely control a hydraulically operated device suspended from a crane eliminates the need to run long hoses to the hydraulic device from the ground as shown in FIG. 1. As a result, the hydraulic device may be more easily used without concerns of having the required length of cable or rupturing the cable on the edge of the roof or gutter.

It is envisioned that the preferred embodiment of the present invention is not limited to remote control using a radio frequency remote controller, but also may be controlled by other devices such as an infrared system or internet connection established by wireless telecommunications. Further, although the preferred embodiment described herein primarily refers to controlling a hydraulic device suspended from a crane, the present invention may also be used remotely control a variety of hydraulic devices whether suspended from a crane or not.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed:

1. A hydraulic device that is sized and constructed to be conventionally used while being remotely operated while being suspended from a crane, said device comprising:

a hydraulic dumpster body portion having a container with an open top and a bottom having at least one hinged door that is opened and closed by hydraulic pressure and that is sized and constructed to be conventionally used while being suspended from the crane;

a hydraulic power enclosure containing a pump, a controller and a power source having a mount on an exterior side of the enclosure for connecting the enclosure to the hydraulic dumpster body portion, the mount having a planar portion with two rails extending away from the enclosure and forming a connection between the enclosure and body portion;

a cylinder for holding hydraulic fluid connected to the body portion located in the hydraulic power enclosure, the at least one hinged door being movable by hydraulic pressure applied to the cylinder;

the pump being connected to the cylinder for pumping pressurized fluid to the cylinder;

the power source being for providing power to the pump;

the controller being connected to the body portion and electrically connected to the pump, the controller including a receiver for receiving a control signal and transmitting power from the power source to the pump based on the control signal to control movement of the at least one hinged door, a manually operated control switch located at the body portion for transmitting power from the power source to the pump to control movement of the at least one hinged door; and a transmitter for remotely transmitting the control signal to the receiver to operate the pump when the hydraulic device is suspended from the crane.

2. The device of claim 1, further comprising:

a valve for controlling the direction of flow of fluid between the cylinder and pump, wherein the receiver transmits current to the valve to operate the valve.

3. The device of claim 1, wherein the enclosure is made of a metal.

4. The device of claim 1, wherein the pump includes a tank and a motor.

5. The device of claim 1, wherein the manually operated control switch comprises open, closed and off positions.

6. The device of claim 1, wherein the rails have a U-shape.

7. The device of claim 6, wherein the device has a frame and the U-shaped rails are adapted to be connected to the frame.

8. The device of claim 7, wherein the frame has plural portions and the U-shaped rails are adapted to be connected to only one of the plural frame portions.

9. The device of claim 1, wherein the dumpster body is adapted to contain building materials when the at least one hinged door is closed and is adapted to dump building materials from the dumpster when the at least one hinged door is opened.

* * * * *